United States Patent [19]

Parker et al.

[11] 4,265,166

[45] May 5, 1981

[54] CORROSION RESISTANT MEMBRANE FOR CHIMNEY LINER

[75] Inventors: John A. Parker, Grand View, Mo.; Sid Handler, Williamsport, Pa.; Randolph W. Snook, Shawnee Mission, Kans.

[73] Assignee: Pullman Incorporated, Chicago, Ill.

[21] Appl. No.: 73,814

[22] Filed: Sep. 10, 1979

[51] Int. Cl.[3] ..... E04H 12/28

[52] U.S. Cl. ..... 98/58; 98/60; 110/184

[58] Field of Search ..... 98/58, 60; 110/184; 126/307 R; 181/207, 208, 211; 114/187

[56] References Cited

U.S. PATENT DOCUMENTS

| | | | |
|---|---|---|---|
| 3,270,769 | 9/1966 | Kasier et al. | 137/375 |
| 3,299,417 | 1/1967 | Sibthorpe | 340/242 |
| 3,363,591 | 1/1968 | Lawrence | 110/184 |
| 3,368,506 | 2/1968 | Lawrence | 110/184 |
| 3,522,767 | 8/1970 | Derringer | 98/58 |
| 3,537,411 | 11/1970 | Roy et al. | 110/184 |
| 3,604,376 | 9/1971 | Meyer | 110/184 |
| 3,669,042 | 6/1972 | Lawrence | 110/184 |
| 3,727,566 | 4/1973 | Roy | 110/184 |
| 3,730,073 | 5/1973 | Potter | 110/184 |
| 4,173,923 | 11/1979 | Snook | 98/58 |

*Primary Examiner*—Ronald C. Capossela
*Assistant Examiner*—Harold Joyce
*Attorney, Agent, or Firm*—Richard J. Myers; Stephen D. Geimer; Paul A. Kerstein

[57] ABSTRACT

A carbon steel (or other type) chimney liner is provided with an inner membrane of relatively light gauge steel which is highly resistant to corrosion and which is constructed to accommodate thermal expansion in any direction independent of the structure to which it is attached. The membrane and chimney liner include an annular space therebetween which is placed under a vacuum.

21 Claims, 8 Drawing Figures

CORROSION RESISTANT MEMBRANE FOR CHIMNEY LINER

BACKGROUND OF THE INVENTION

1. Field of the invention

The present invention broadly relates to chimneys and particularly to a chimney liner the interior of which is protected by a corrosion resistant membrane.

2. Description of the Prior Art

Chimney liners or chimney stacks pertinent to the present invention are shown in U.S. Pat. No. 3,368,506, patented Feb. 13, 1968 and U.S. Pat. No. 3,669,042, patented June 13, 1972. These patents disclose chimney liners with corrugations adapted to accommodate thermal expansion. U.S. Pat. No. 3,270,769, Sept. 6, 1966 discloses a piping system which includes jacketed pipe which may be subjected to a slight vacuum to enhance the insulation of the system.

U.S. Pat. No. 3,299,417 discloses a pressure tube and conduit having a space therebetween which in the event of a leak will trigger an alarm. U.S. Pat. No. 3,730,073, May 1, 1973 shows an outer shell and an inner liner of a stack provided with corrugations to accommodate thermal expansion.

U.S. Pat. No. 3,537,411 discloses a chimney having an inner layer which, like the present invention, consists of a plurality of separate sheets welded together and which also provides a space between the shell and the inner liner. However, this patent does not disclose the vacuum arrangement nor the specific structure which is claimed in the present combination. The patent showing corrugations disclose only a feature of the present invention. The prior art patents do not disclose the specific combination which is herein described and claimed.

SUMMARY OF THE INVENTION

In the present invention, a chimney includes a reinforced concrete outer column in which is disposed a chimney liner of tubular form through which the smoke constituents are released to the atmosphere. The chimney liner extends upwardly within the reinforced concrete outer column and is made of a carbon steel or other material. While shown as a continuous single column, the chimney liner is constructed of individual stacked tubular sections seam welded together at adjacent edges of the sections. The inner surface of the chimney liner is protected by a membrane consisting of a multiplicity of individual steel plate sections welded together and which are vertically coextensive with the chimney liner. The plate sections are connected to the chimney liner at the upper end (of each section) to provide a vertical annular space extending the length of the chimney liner. The plates are joined together by welding at the edges to form a continuous membrane. Connection of the membrane to the inner wall of the liner is made by means of vertically extending straps or hangers having upper edges connected to the liner and lower edges which are connected to the top of each membrane section. Thus these hanger members are placed at each of the horizontal seams of the membrane and suspend the membrane from the inner surface of the chimney liner. The hangers also allow the membrane to expand radially within the liner. The width of the annulus is determined by the amount of radial expansion to be accomodated. Also each of the sections is provided with a circumferentially extending corrugation to accomodate axiel expansion. The spacing of the corrugations is determined by the amount of axiel expansion to be accomodated.

After installation, the annular space provided is subjected to a vacuum to provide a negative pressure within the space in order to prevent flutter or vibration of the membrane and overcome implosion effects within the chimney. Tubular connections are positioned on the outer surface of the liner adjacent to each of the stacked sections of membrane which may be utilized for determining whether or not any of the sectional connections of the membrane leak. Presence of contaminants in the annular space would indicate a leak in the membrane section adjacent to the connection. The outer liner also includes a flue entrance duct which is similarly constructed as the outer liner and includes a membrane also of individual sections which are supported in position by the hangers previously described.

DESCRIPTION OF THE PREFERRED EMBODIMENT

Figure 1:
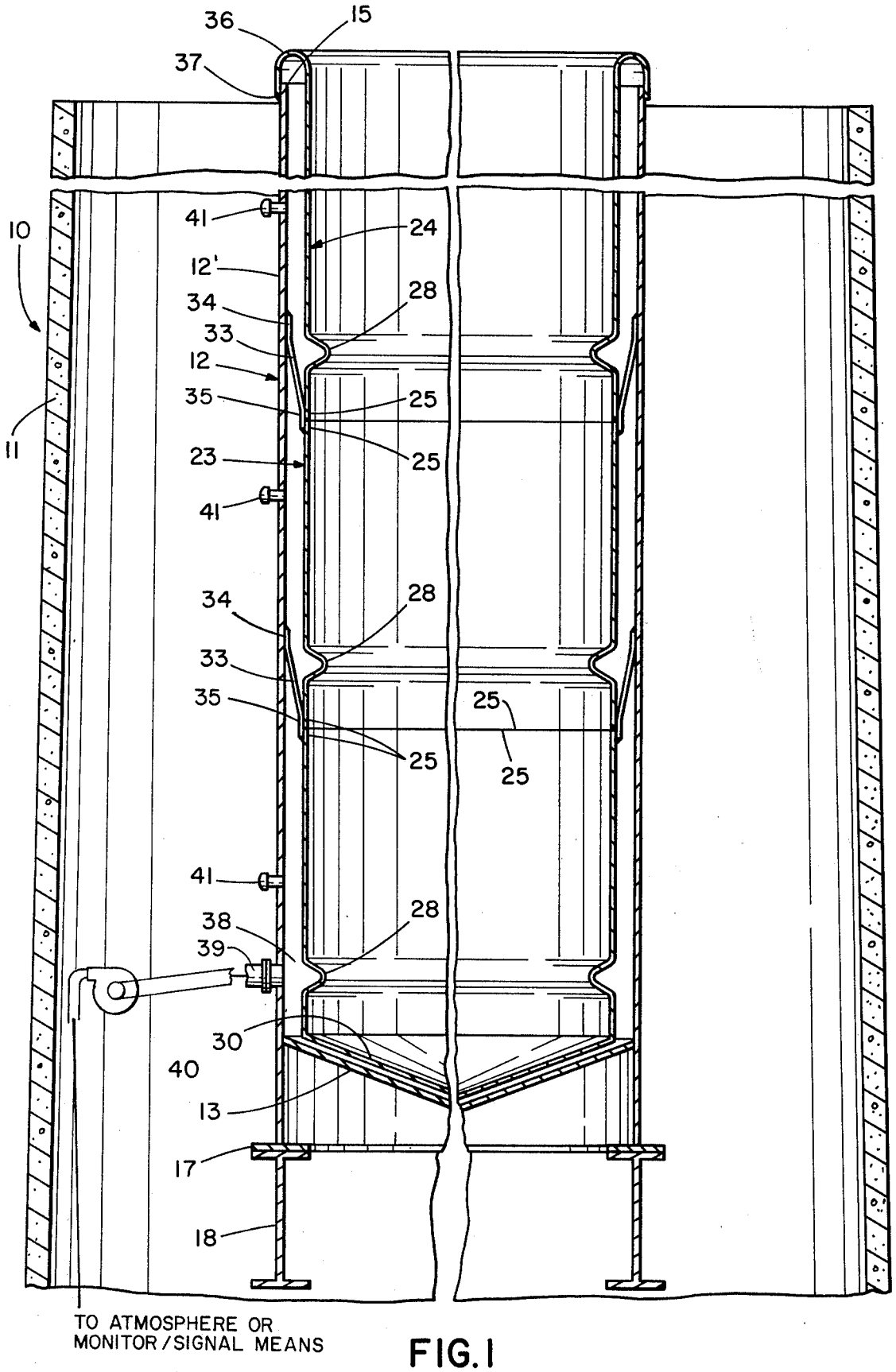
FIG. 1 is a cross-sectional view through a chimney including an outer shell, a liner and an inner membrane.
Figure 2:
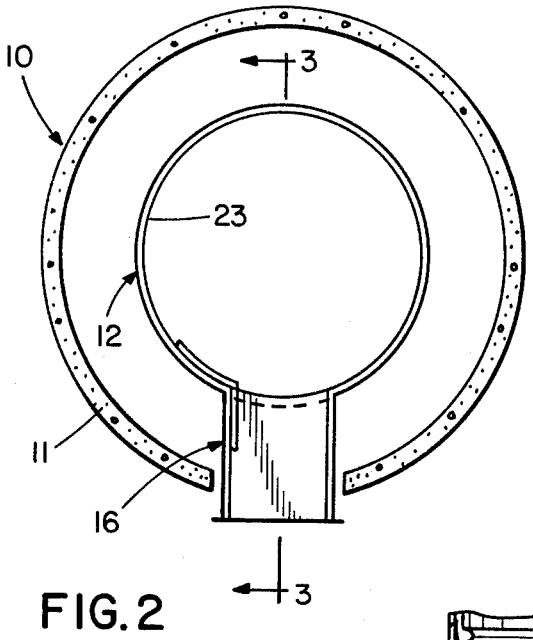
FIG. 2 is a cross-sectional view through the chimney also disclosing a flue entrance duct.
Figure 3:
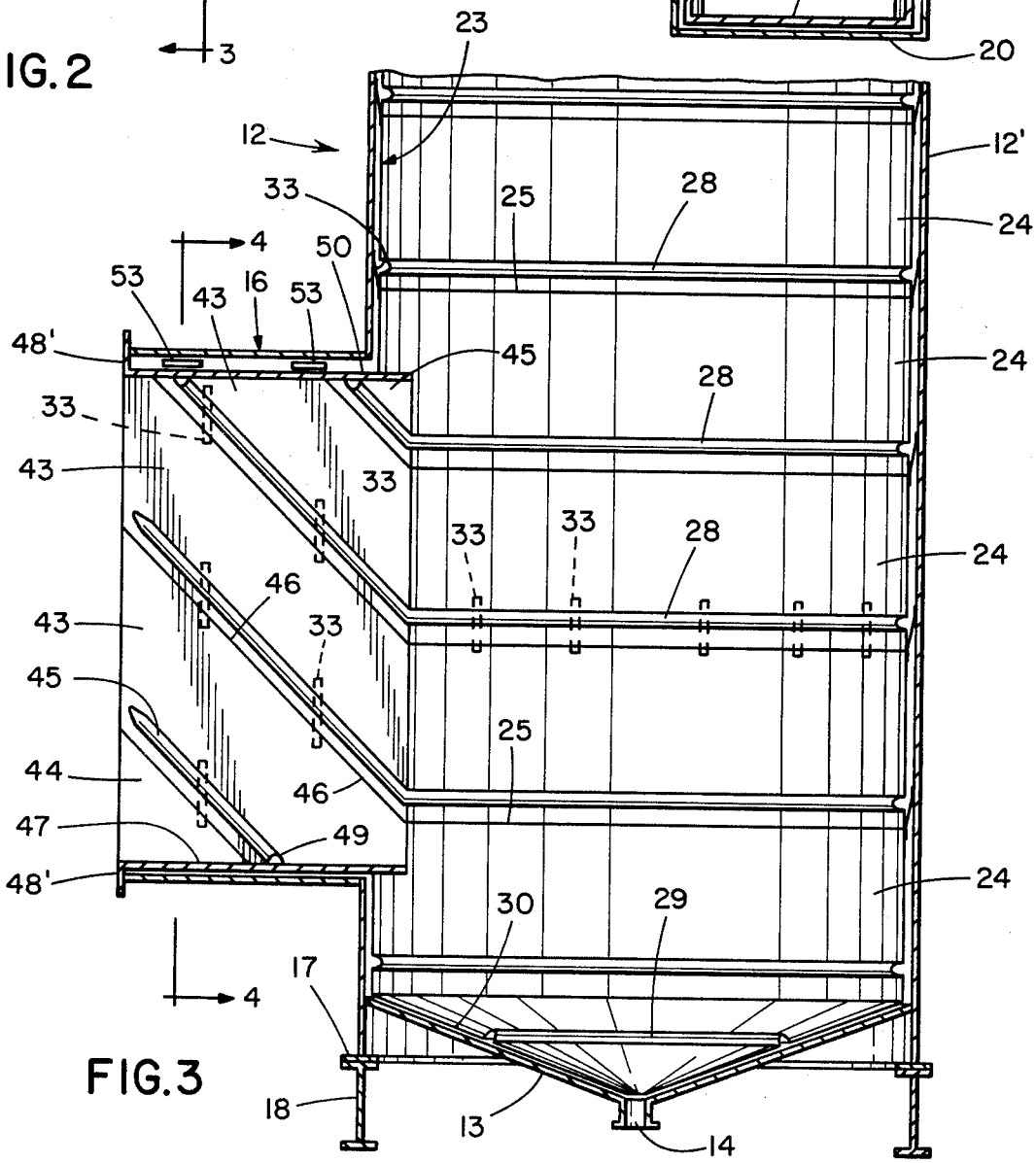
FIG. 3 is a cross-sectional view taken substantially along the line 3–3 of FIG. 2.

FIG. 1 discloses a chimney generally designated as 10 each includes an outer reinforced tubular column 11 within which is positioned a tubular liner 12. The liner 12 is generally constructed of carbon steel, but can be constructed of other materials, sections connected together which extend throughout the length of the protective outer reinforced tubular column 11. The liner 12 also includes a cylindrical wall 12' and is provided at its lower end with a concave, or flat, floor 13 having a central outlet drain 14. The liner 12 is provided at its top with an upper circumferential edge 15. As best shown in FIGS. 2 and 3 a flue entrance duct or box of rectangular design is designated as 16 and as shown in FIG. 2 communicates with the tubular liner 12. The lower end of the liner 12 is provided with a flange ring 17 suitably connected to and seated upon an annular ring 18 suitably supported. The rectangular flue entrance duct 16 is provided with an upper wall 19, a lower wall 20, and connected side walls 21 and 22.

Figure 7:
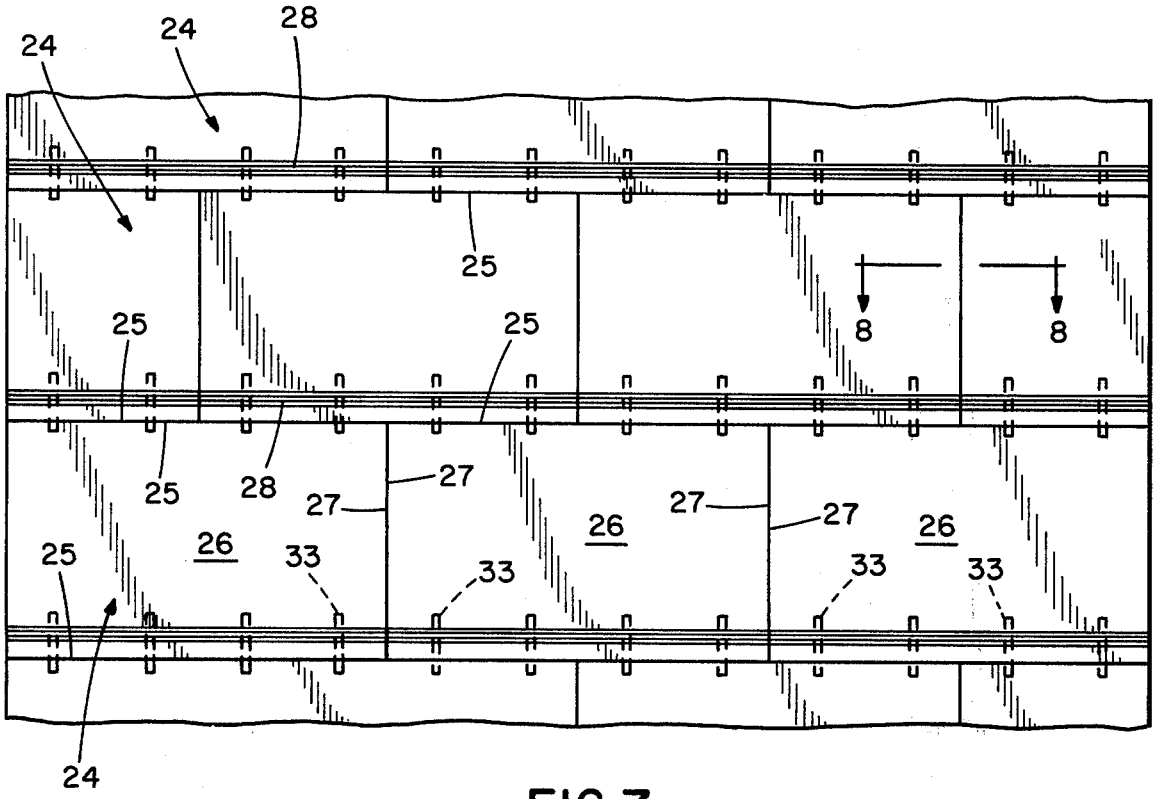
FIG. 7 is an elevational view of a membrane disclosing stacked sections.
Figure 8:
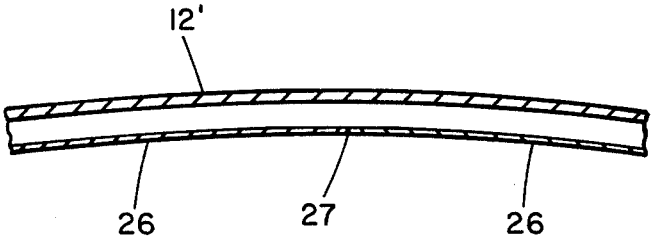
FIG. 8 is a cross-sectional view taken along the line 8—8 of FIG. 7.

The tubular liner has connected thereto an inner membrane 23 consisting of a plurality of tubular sections 24. The tubular sections 24, as best shown in FIG. 7, each includes upper and lower adjacent horizontal or circumferential extending ends or seam portions 25. Each of the sections 24 is formed by a plurality of rectangular individual plates 26 having vertically adjacent edges 27 suitably welded together to provide a continuous membrane like structure. As best shown in FIG. 1 and FIG. 7, each of the sections is provided with circumferentially extending corrugations 28 providing for the thermal expansion of the membrane in a vertical or axiel direction. Further, the concave, or flat, floor 13 of the liner 12 supports a membrane floor 30 which may consist of one or more corrugations 29 providing for thermal expansion in a horizontal direction. As best shown in FIGS. 7 and 8 the adjacent edges 27 of the plates 26, are lap and seam welded together in both vertical and horizontal directions.

Each of the sections is suitably suspended from the inner surface of the liner 12 by means of vertical straps 33. Straps 33 extend circumferentially between the inner liner surface and the outer surface of the membrane 23 having upper ends 34 connected to the inner surface of the liner 12 and lower ends 35 connected or welded to the membrane sections. The hanger straps 33 are equally spaced circumferentially and provide suspension means for securing the membrane in position and are flexible enough in the radial direction to allow the membrane to expand. The membrane 23 is also provided at its upper end with a loop end portion 36 suitably welded at 37 to the upper end 15 of the liner 12. The membrane 23 as indicated in FIG. 1, with the inner surface of the liner 12, provide an annular space 38 which has connected thereto a vacuum pump connection 39 to which a vacuum pump 40 is connected to provide a minus atmospheric pressure within the space. The vacuum is functional to prevent flutter of the membrane during operation. Capped connections 41 are also provided substantially midway of the vertical length of each of the tubular sections 24, these serving to provide sampling access to the interior of the space to determine if there is any contamination which in turn then would indicate that a leak in that area has occurred and repair is required.

Figure 4:
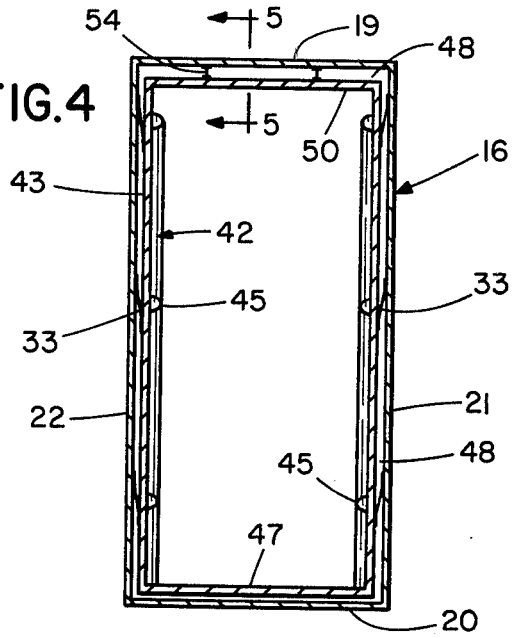
FIG. 4 is a cross-sectional view taken along the line 4—4 of FIG. 3.

The rectangular flue entrance duct 16 is also similarly constructed and includes a flue membrane lining 42 consisting of connected sections 43 and upper and lower end sections 44 each being provided with diagonal corrugations 45 the adjacent ends 46 of which are interconnected by welding, the same also being similarly suspended by means of the straps 33 which are of identical design to those previously mentioned for connecting the main body of the membrane to the outer shell. Similarly, as shown in FIG. 4, the rectangular space 48 is similar to the space 38 and is in communication therewith. The edge of the rectangular entrance duct is closed by means of an end wall 48' shown in FIG. 3 so that the space 48 is enclosed from the atmosphere.

Figure 5:
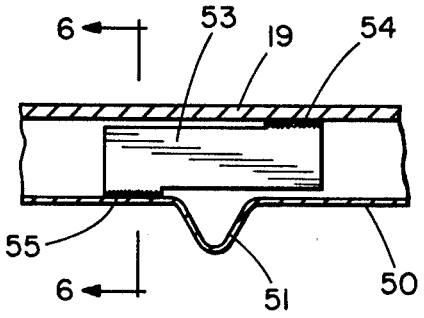
FIG. 5 is a cross-sectional view taken along the line 5—5 of FIG. 4.
Figure 6:
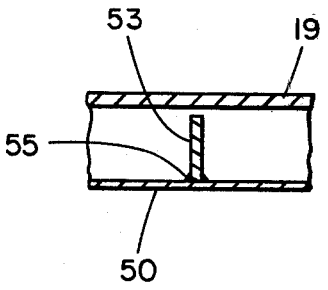
FIG. 6 is a cross-sectional view taken along the line 6—6 of FIG. 5.

The flue membrane floor 47 also includes a horizontal corrugation 49 as best shown in FIG. 3. The top wall of the membrane of the entrance duct is designated as 50 and includes a horizontally extending corrugation 51. FIG. 5 discloses a hanger member 53 suspended from the wall 19 and suitably welded to the membrane 50 by means of a weld 55. As shown in FIG. 5, the hanger 53 is welded at 54 to the wall 19. Thus the top membrane of the duct is suspended by means of the hangers 53 from the top wall 19.

The membrane disclosed may be constructed of material known as "INCONEL 625" or similar corrosion resistant steel. The membrane is of a relatively light gauge metal. The vacuum system between the membrane and structural liner is for the purpose of holding the membrane to the liner wall thereby reducing flow induced vibrations, or flutter, in the membrane. The corrugations provide for vertical thermal expansion of the membrane and the hanger straps allow for radial and circumferential thermal expansion and for the proper support of the membrane in its relatively spaced position with respect to the inner wall of the liner 12. Tests may be taken at the capped connections 41 to determine whether or not any contamination is found in the annular space 38 which would then indicate that a leak is present in the membrane. The membrane then, of course, would be repaired. Also the vacuum pump may include monitoring means or signaling means which would indicate a leak thereby signaling that a repair is required. The material utilized in the membrane prevents the corrosion of the inner wall of the chimney liner thus increasing the life of the same.

What is claimed is:

1. A chimney having in combination;

a tubular outer vertically extending liner, an inner tubular membrane shell substantially vertically coextensive with said liner and being radially spaced therefrom to provide and an annular enclosed space therebetween, means supporting said inner membrane from said outer liner, and means connected to said liner communicating with said space to provide a minus atmospheric pressure within said space.

2. The invention in accordance with claim 1, said inner membrane including a plurality of vertically spaced circumferentially extending corrugatioins.

3. The invention in accordance with claim 2, said outer liner having a flat floor, and said inner membrane having a second floor including corrugation means supported on said first floor.

4. The invention in accordance with claim 1, said supporting means including vertical hanger straps connected to said liner and inner membrane.

5. The invention in accordance with claim 4, said straps having their upper ends connected to said liner and their lower ends connected to said inner membrane.

6. The invention in accordance with claim 4, said inner membrane comprising a plurality of individual tubular sections connected together at their vertically spaced ends.

7. The invention in accordance with claim 6, said hanger straps having their upper ends connected to said liner and their lower ends connected to said inner membrane at the connected ends of said tubular sections.

8. A chimney liner having a combination;

a tubular outer vertically extending liner, an inner tubular member substantially vertically coextensive with said outer liner and being radially spaced therefrom to provide an annular enclosed vertical space therebetween, means supporting said inner tubular member from said liner including a plurality of straps circumferentially spaced within said liner, a flue entrance duct comprising an outer tubular duct and an inner tubular flue membrane disposed therein in spaced relation to providean enclosed horizontal space, said outer duct and inner flue membrane extending horizontally outwardly from said chimney with said vertical space communicating with said horizontal space, and means communicating with said spaces to provide a minus atmospheric pressure therein.

9. The invention in accordance with claim 8, said inner tubular member comprising a plurality of individual tubular sections stacked one on top of the other and having adjacent ends connected together.

10. The invention in accordance with claim 9, said hanger strap lower ends being connected to said inner tubular member at the connection of said adjacent ends.

11. The invention in accordance with claim 10, said inner tubular member having vertically spaced circumferentially extending corrugations.

12. The invention in accordance with claim 11, said corrugations being spaced to accommodate thermal expansion between levels of hanger straps.

13. The invention in accordance with claim 11, said inner tubular liner including a floor having corrugated means, and said liner having a second floor supporting said first floor.

14. The invention in accordance with claim 8, said inner flue membrane including vertically spaced corrugations.

15. The invention in accordance with claim 14, said inner flue membrane comprising a plurality of rectangular sections positioned in stacked relation and having adjacent edges connected together.

16. The invention in accordance with claim 15, said edges extending diagonally.

17. The invention in accordance with claim 1, including strap means connected to said outer tubular duct and to said inner flue membrane adjacent to said connected edges.

18. The invention in accordance with claim 8, said outer duct being in communication with said tubular outer liner.

19. The invention in accordance with claim 8, said tubular outer liner including capping places providing access to said annular enclosed space.

20. The invention in accordance with claim 8, said means communicating with said spaces being a vacuum pump.

21. The invention in accordance with claim 20, said vacuum pump cooperating with a monitor or signal means to indicate a leak in the inner tubular member.

* * * * *